US011268211B2

(12) United States Patent
Kinoshita et al.

(10) Patent No.: US 11,268,211 B2
(45) Date of Patent: Mar. 8, 2022

(54) ELECTROSPINNING HEAD AND ELECTROSPINNING APPARATUS

(71) Applicant: Kabushiki Kaisha Toshiba, Minato-ku (JP)

(72) Inventors: Shizuo Kinoshita, Yokohama (JP); Kenya Uchida, Yokohama (JP); Satomi Sakai, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 364 days.

(21) Appl. No.: 16/387,586

(22) Filed: Apr. 18, 2019

(65) Prior Publication Data

US 2019/0323149 A1 Oct. 24, 2019

(30) Foreign Application Priority Data

Apr. 20, 2018 (JP) ..... JP2018-081332

(51) Int. Cl.

| | |
|---|---|
| ***D01D 5/00*** | (2006.01) |
| ***D01D 4/02*** | (2006.01) |
| ***D01D 4/06*** | (2006.01) |
| ***D01D 5/18*** | (2006.01) |
| ***D01F 11/04*** | (2006.01) |

(52) U.S. Cl.

CPC ..... *D01D 5/0069* (2013.01); *D01D 4/02* (2013.01); *D01D 4/06* (2013.01); *D01D 5/0092* (2013.01); *D01D 5/18* (2013.01); *D01F 11/04* (2013.01)

(58) Field of Classification Search

CPC ..... D01D 5/0069; D01D 4/02; D01D 4/06; D01D 5/0092; D01D 5/18; D01D 5/003; D01D 5/0061; D01D 5/0007; D01D 5/0038; D04H 1/728; D01F 11/04

See application file for complete search history.

(56) References Cited

U.S. PATENT DOCUMENTS

2002/0122840 A1* 9/2002 Lee ..... D01D 5/0061 425/174.6

2005/0233021 A1 10/2005 Chun et al.

(Continued)

FOREIGN PATENT DOCUMENTS

JP 8-153669 6/1996

JP 2005-534828 11/2005

(Continued)

OTHER PUBLICATIONS

Extended European Search Report dated Jul. 9, 2019, in Patent Application No. 19168391.1, 7 pages.

*Primary Examiner* — Jacob T Minskey

*Assistant Examiner* — S. Behrooz Ghorishi

(74) *Attorney, Agent, or Firm* — Oblon, McClelland, Maier & Neustadt, L.L.P.

(57) ABSTRACT

In one embodiment, an electrospinning head has a nozzle unit and a control body. The nozzle unit is arranged opposite to a base material, is applied with a voltage, and thereby is capable of discharging a raw material liquid of fiber. The control body is arranged in the vicinity of the nozzle unit so as to extend to an outside of a spinning space between the base material and the nozzle unit. Further, the control body is applied with a voltage of the same polarity as the voltage to be applied to the nozzle unit, and thereby is capable of making an electric field to be generated at the periphery of the nozzle unit.

8 Claims, 12 Drawing Sheets

(56) References Cited

U.S. PATENT DOCUMENTS

| | | | | |
|---|---|---|---|---|
| 2016/0068998 | A1 | 3/2016 | Naka | |
| 2017/0268131 | A1 | 9/2017 | Nakamura et al. | |
| 2018/0223451 | A1* | 8/2018 | King | D01D 5/0069 |

FOREIGN PATENT DOCUMENTS

| | | |
|---|---|---|
| JP | 2017-31517 | 2/2017 |
| JP | 2017-166100 | 9/2017 |
| WO | WO 2017/017442 A1 | 2/2017 |

* cited by examiner

ELECTROSPINNING HEAD AND ELECTROSPINNING APPARATUS

CROSS-REFERENCE TO RELATED APPLICATION

This application is based upon and claims the benefit of priority from the prior Japanese Patent Application No. 2018-081332, filed on Apr. 20, 2018, the entire contents of which are incorporated herein by reference.

FIELD

Embodiments described herein generally relate to an electrospinning head, and an electrospinning apparatus using an electrospinning head.

BACKGROUND

Conventionally, an electrospinning apparatus which forms a fiber film on a base material using an electrospinning method is known. The conventional apparatus discharges a raw material liquid (fiber) toward the base material from an electrospinning head (hereinafter, simply called a head), while conveying the base material.

The above-described apparatus, in order to control spread of the fiber which has been discharged from the head and is flying, in the width direction of the base material, has control units which are arranged at the both ends of the head and extend in the base material direction from the head.

Further, the conventional apparatus, in order to induce the fiber the spread of which has been controlled by the control units onto the base material, has induction units which are respectively provided between the control units and the base material.

DETAILED DESCRIPTION

According to one embodiment, an electrospinning head has a nozzle unit and a control body. The nozzle unit is arranged opposite to a base material, is applied with a voltage, and thereby is capable of discharging a raw material liquid of fiber. The control body is arranged in the vicinity of the nozzle unit so as to extend to an outside of a spinning space between the base material and the nozzle unit. Further, the control body is applied with a voltage of the same polarity as the voltage to be applied to the nozzle unit, and thereby is capable of making an electric field to be generated at the periphery of the nozzle unit.

Hereinafter, embodiments will be described, with reference to the drawings. In addition, X, Y, Z directions in the respective drawings are common directions throughout the whole drawings, and are directions orthogonal to each other. In addition, the X direction is a direction in which a nozzle 311*a* extends toward a base material 40, and an X1 direction is a conveying direction of the base material 40 in a horizontal conveying path. In addition, the Y direction is a direction orthogonal to a width direction of the base material 40, and is a conveying direction of the base material 40 in a vertical conveying path 64. In addition, the Z direction is the width direction of the base material 40, and is a direction in which nozzles 311*a* of nozzle units 311 included in a head 31 are arranged.

Figure 1:
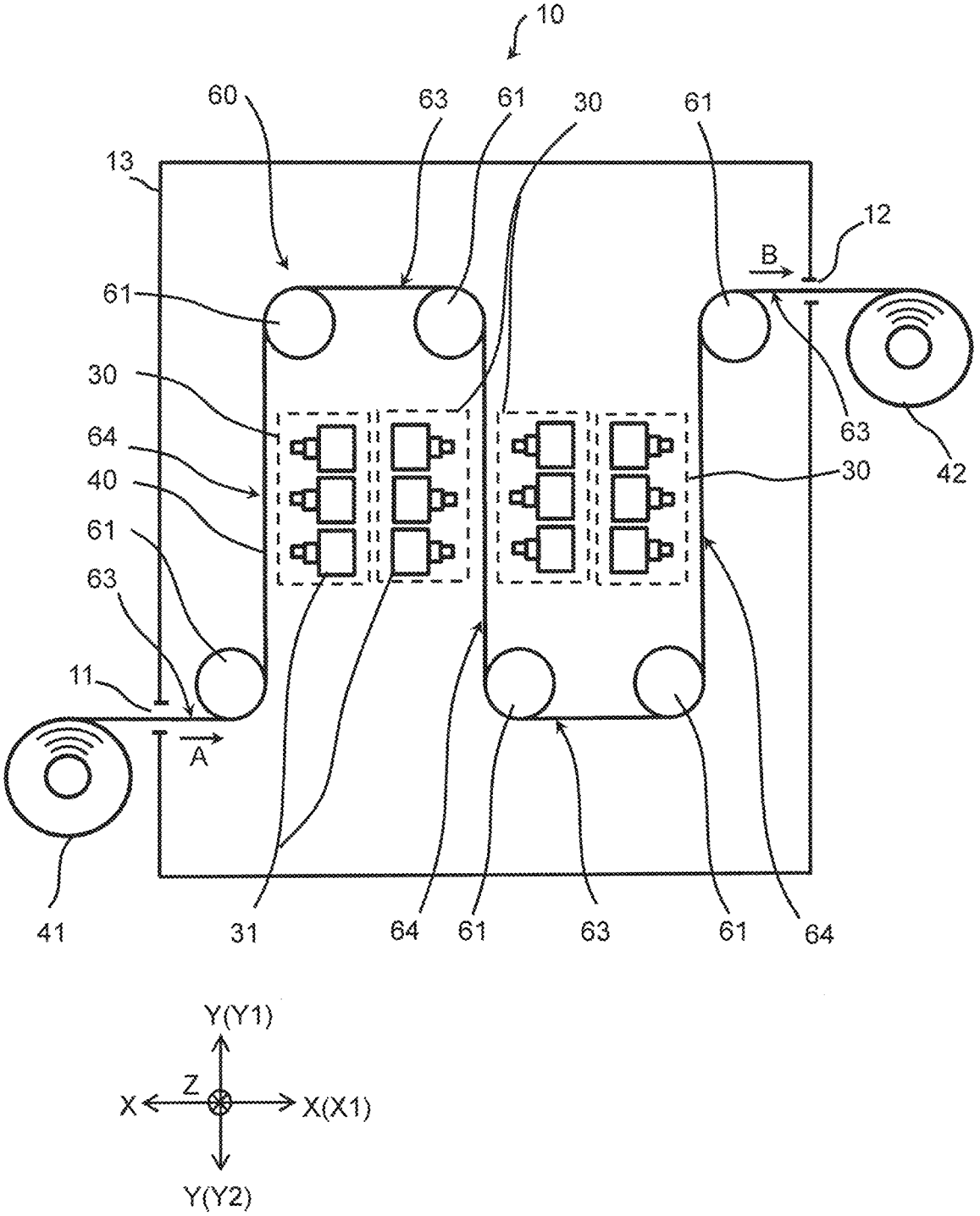
FIG. 1 is a diagram showing an electrospinning apparatus according to an embodiment.
Figure 2:
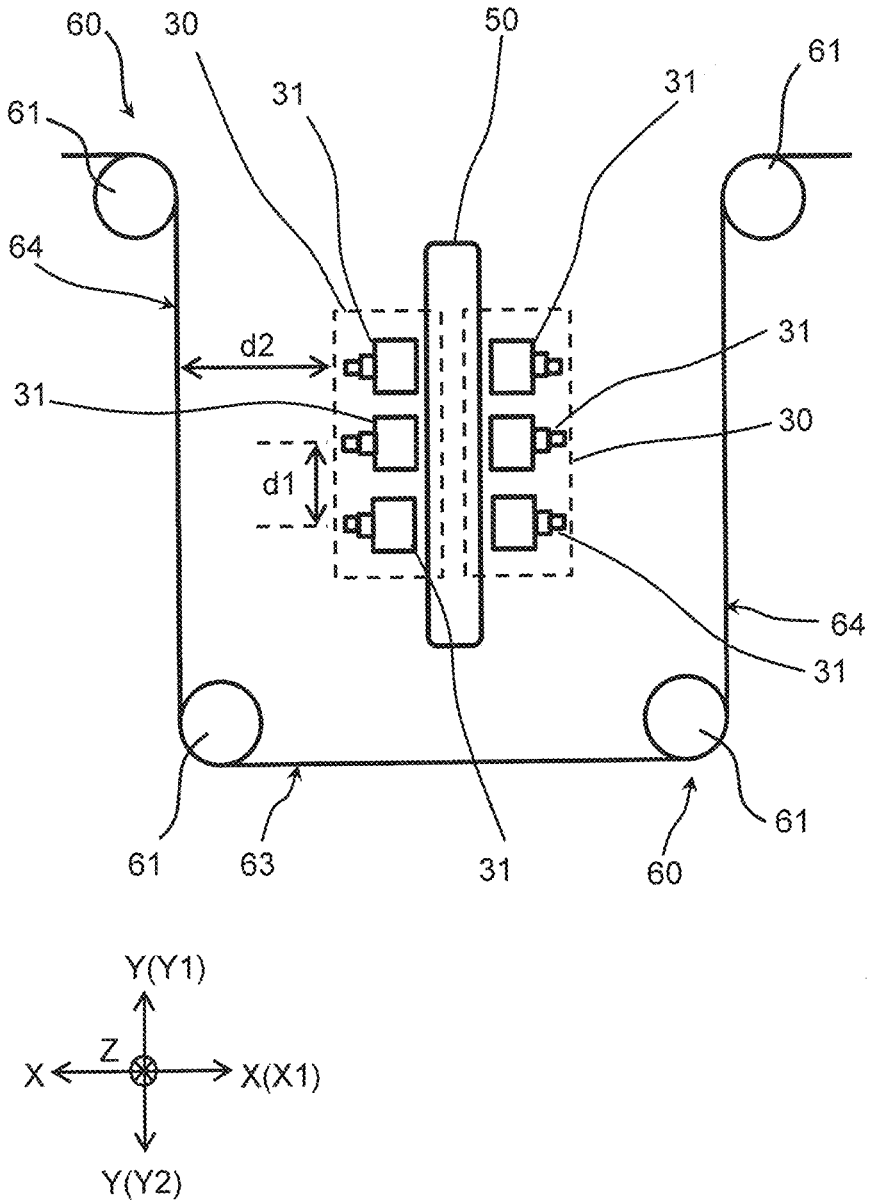
FIG. 2 is a partially enlarged diagram schematically showing a structure at the periphery of the head unit of the apparatus shown in FIG. 1.
Figure 3:
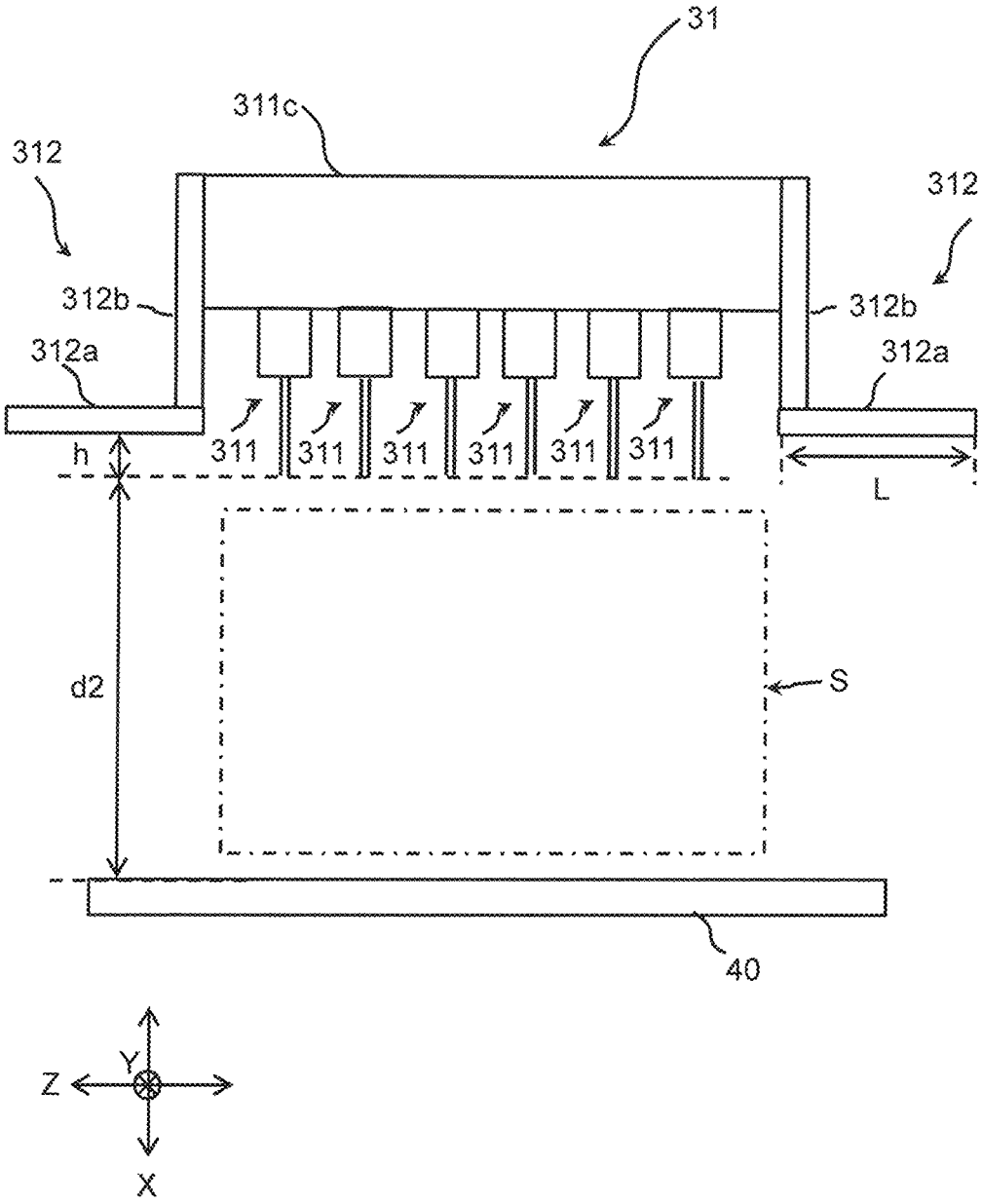
FIG. 3 is a side view which is seen from the direction orthogonal to the width direction of the base material, and shows an example of the electrospinning head according to the embodiment.

To begin with, the whole of the embodiment will be schematically described. FIG. 1 and FIG. 2 are diagrams each showing an inside of an electrospinning apparatus 10 (hereinafter, simply called an apparatus 10) according to the embodiment. FIG. 3 is a diagram showing an electrospinning head 31 (hereinafter, simply called a head 31) to be used in the apparatus 10.

The apparatus 10 is an example of an apparatus to form a fiber film on the base material 40 by a well-known electrospinning method. The apparatus 10 has the conveying path 64 (hereinafter, called the vertical conveying path 64) to convey the base material 40 in the Y direction. The head 31 discharges a raw material liquid (fiber) toward the base material 40 to be conveyed in the vertical conveying path 64.

Here, the fiber discharged from the head 31 flies in a spinning space S (refer to FIG. 3) in which the head 31 and the base material 40 are opposite to each other, reaches the base material 40, and is deposited on the base material 40. On the other hand, the fiber tries to fly while spreading also outside the spinning space S (the Z direction in FIG. 3).

Accordingly, in order to surely deposit the fiber on the base material 40 to form a fiber film, it is necessary to control spread of flight of the fiber, and to induce the flying fiber onto the base material 40. In addition, the spinning space S in FIG. 3 is a schematic space in order to make the description easier to understand, and an actual spinning space is not limited to the spinning space S of FIG. 3.

Meanwhile, the head 31 to be used in the apparatus 10 has a control body 312*a* described later. The control body 312*a* suppresses spread of flight of the fiber, and controls induction of the fiber to the base material 40.

Accordingly, according to the present embodiment, though having a simple configuration, the apparatus 10 suppresses spread of the flying fiber, and controls induction of the fiber to the base material. Thereby the apparatus 10 can improve quality and productivity of the fiber film, and consequently can reduce an apparatus cost. In addition, in the following description, it is sometimes called simply flight control of the fiber to suppress spread of the flying fiber and control induction of the fiber to the base material.

Next, respective portions of the apparatus 10 will be described in detail, with reference to FIG. 1, FIG. 2 and FIG. 10. The apparatus 10 has a power source 20, head units 30, an unwinding reel 41, a winding reel 42, supports 50, and a conveying device 60.

To begin with, the power source 20 will be described. The power source 20 is connected to the respective heads 31 of the head unit 30 described later. In order to charge the raw material liquid to be fed to each of the heads 31, the power source 20 applies a voltage of 30-50 kV for example to the head 31.

In addition, the power source 20 is connected to the control body 312*a* described later of each of the heads 31. The power source 20 applies a voltage to the control body 312*a* for flight control of the fiber. The voltage to be applied to the control body 312*a* has the same polarity and the same value as those of the voltage to be applied to the head 31, for example.

In the present embodiment, the power source 20 is used commonly as the power source for applying the voltage to the head 31, and the power source for applying the voltage to the control body 312*a*, but a power source for the head 31 and a power source for the control body 312*a* may be separate power sources, respectively.

Next, the head unit 30 will be described. The head units 30 are respectively arranged at the both sides of the vertical conveying path 64 to convey the base material 40 in the Y direction of FIG. 1, and are opposite to the base material 40 to be conveyed in the vertical conveying path 64. The head unit 30 may be arranged at only one side of the vertical conveying path 64, but in order to improve a forming speed of the fiber film, the head units 30 are respectively arranged at the both sides of the vertical conveying path 64.

The head unit 30 includes one or more heads 31. In the present embodiment, the head unit 30 includes the three heads 31, for example, as shown in FIG. 1.

In addition, in the present embodiment, the apparatus 10 has the three vertical conveying paths 64 as shown in FIG. 1. Accordingly, the apparatus 10 has a total of the four head units 30 as shown in FIG. 1, but the number of the vertical conveying paths 64 and the number of the head units 30 are not limited to these, respectively.

In addition, the three heads 31 of the head unit 30 are supported by the support 50, as shown in FIG. 2, and thereby they are arranged along the vertical conveying path 64 in the vertical direction (the Y direction of FIG. 2). Intervals d1 (refer to FIG. 2) between the respective heads 31 may be made the same, for example. In addition, the respective heads 31 have the same structure. The structure of the head 31 will be described later.

In addition, intervals d2 (refer to FIG. 2) between the respective heads 31 and the base material 40 are the same, for example. The interval d2 is determined by a discharge condition including a voltage applied by the power source 20, a kind of a raw material of the fiber in the raw material liquid, and a concentration of the raw material, and so on.

In addition, the respective heads 31 are connected to a raw material liquid storage tank not shown, via a liquid feeding mechanism not shown. The raw material liquid is a solution in which a raw material of the fiber is dissolved in a solvent at a prescribed concentration.

The raw material of the fiber is not particularly limited, and can be changed arbitrarily in accordance with the material of the fiber film to be formed. As the raw material of the fiber, a polyolefin system resin, a thermoplastic resin, a thermosetting resin, and so on are quoted, for example. As a specific example, the raw material can be formed by one kind of polymer or mixed spinning of two or more kinds of polymers selected from the group consisting of polystyrene, polycarbonate, polymethyl methacrylate, polypropylene, polyethylene, polyethylene terephthalate, polybutylene terephthalate, polyamide, polyoxymethylene, polyamide-imide, polyimide, polysulfone, polyethersulfone, polyetherimide, polyether ketone, polyphenylene sulfide, modified polyphenylene ether, syndiotactic polystyrene, liquid crystal polymer, that are thermoplastic resins, a urea resin, unsaturated polyester, a phenol resin, a melamine resin, an epoxy resin that are thermosetting resins, and a copolymer containing these, and so on. In addition, the raw material of the fiber which can be applied to the present embodiment is not limited to the listed raw materials. The listed raw materials of the fiber are just exemplified.

The solvent may be used as long as it can dissolve the raw material of the fiber. The solvent can be changed arbitrarily in accordance with the raw material of the fiber to be dissolved. As the solvent, a volatile organic solvent such as an alcohol system solvent and an aromatic system solvent, or water can be used. As the organic solvent, specifically, isopropanol, ethylene glycol, cyclohexanone, dimethylformamide, acetone, ethyl acetate, dimethylacetamide, N-methyl-2-pyrolidone, hexane, toluene, xylene, methyl ethyl ketone, diethyl ketone, butyl acetate, tetrahydrofuran, dioxane, pyridine, and so on are quoted, for example. In addition, the solvent may be one kind of solvent, or mixture of plural kinds of solvents, selected from the listed solvents. In addition, the solvent which can be applied to the present embodiment is not limited to the listed solvents. The listed solvents are just exemplified.

With the above-described configuration, the head units 30 discharge the charged raw material liquids from the heads 31 described later to simultaneously form the fiber films on the both surfaces of the base material 40 to be conveyed in the vertical conveying path 64, respectively.

That is, to begin with, the raw material liquid is fed to each of the heads 31 of the head unit 30 from the raw material liquid storage tank via the liquid feeding mechanism. In addition, the voltage is applied to the head 31 by the power source 20.

The head 31 discharges the charged raw material liquid toward one surface of the base material 40 to be conveyed in the vertical conveying path 64. The solvent in the raw material liquid which has been discharged from the head 31 volatilizes in the atmosphere in the apparatus 10.

The raw material (fiber) in the raw material liquid which has been discharged from the head 31 flies and reaches the one surface of the base material 40 to be conveyed in the vertical conveying path 64, and thereby the fiber film is formed on each of the both surfaces of the base material 40.

In addition, a part of the fiber which has been discharged from the head 31 tries to fly also in the width direction (the Z direction of FIG. 1) of the base material 40 to be conveyed in the vertical conveying path 64. But flight control of the fiber is performed by the control body 312*a*, as described later.

Next, the unwinding reel 41 and the winding reel 42 will be described. The unwinding reel 41 and the winding reel 42 are rotated by a drive source not shown. The unwinding reel 41 feeds the base material 40 into a chassis 13, via an inlet port 11 of the chassis 13 of the apparatus 10 (refer to an arrow A of FIG. 1). The winding reel 42 recovers the base material 40 formed with the fiber films to be discharged from an outlet port 12 of the chassis 13 (refer to an arrow B of FIG. 1). In addition, the base material 40 is a sheet-like electrode, for example. Aluminum is quoted as the material of the base material 40, for example.

The base material 40 which has been fed in the apparatus 10 is extended among a plurality of rollers 61 of the conveying device 60, and thereby is conveyed via the vertical conveying path 64.

After having been formed with the fiber films by the head units 30 arranged in the vertical conveying paths 64, the base material 40 is discharged outside the apparatus 10 from the outlet port 12 (refer to the arrow B of FIG. 1), and is recovered by the winding reel 42.

Next, the support 50 will be described. As shown in FIG. 2, the support 50 supports the head unit 30 opposite to the base material 40 to be conveyed in one vertical conveying path 64, and the head unit 30 opposite to the base material 40 to be conveyed in the other vertical conveying path 64.

Next, the conveying device 60 will be described. In order to convey the base material 40, the conveying device 60 has a plurality of the rollers 61 and the drive source 62 (refer to FIG. 10).

The plurality of rollers 61 are arranged at the prescribed positions in the apparatus 10 and support the base material 40, to form a plurality of horizontal conveying paths 63 to convey the base material 40 in the X1 direction, and a plurality of the vertical conveying paths 64 to convey the base material 40 in the Y direction.

In order to feed the base material 40 to the vertical conveying path 64, and convey the base material 40 which has passed through the vertical conveying path 64 and has been formed with the fiber film to the next vertical conveying path 64 or outside the apparatus 10, each of the horizontal conveying paths 63 is connected to the both end portions in the Y direction of the vertical conveying paths 64.

In the present embodiment, the four horizontal conveying paths 63 are formed by the rollers 61, as shown in FIG. 1. Specifically, the horizontal conveying paths 63 include one conveying path to convey the base material 40 to be fed from the inlet port 11 to the first vertical conveying path 64.

In addition, the horizontal conveying paths 63 include two conveying paths each of which conveys the base material 40 that has passed through the one vertical conveying path 64 to the next vertical conveying path 64.

Further, the horizontal conveying paths 63 include one conveying path to convey the base material 40 which has passed through the last vertical conveying path 64 to the outlet port 12.

In the present embodiment, the first horizontal conveying path 63 which conveys the base material 40 to be fed from the inlet port 11 connects to the lower end portion (the end portion in the Y2 direction of FIG. 1) of the vertical conveying path 64. The next and following horizontal conveying paths 63 alternately connect to the upper end portions (the end portion in the Y1 direction of FIG. 1) and the lower end portions of the two opposing vertical conveying paths 64, and the last horizontal conveying path 63 connects to the upper end portion of the vertical conveying path 64.

In addition, in the present embodiment, the three vertical conveying paths 64 are formed by the rollers 61, as shown in FIG. 1. Each of the vertical conveying paths 64 connects to the horizontal conveying paths 63, as described above.

Accordingly, the first vertical conveying path 64 conveys the base material 40 toward the Y1 direction. The next vertical conveying path 64 conveys the base material 40 toward the Y2 direction, and the further next vertical conveying path 64 changes the direction thereof to the Y1 direction and conveys the base material 40 toward the Y1 direction.

In addition, the number of the vertical conveying paths 64, the number of the horizontal conveying paths 63 and the number of the rollers 61 are not limited to the numbers of the present embodiment, respectively.

The drive source 62 has a motor to rotate a plurality of the rollers 61. The drive source 62 may have a plurality of motors for rotating a plurality of the rollers 61, respectively, or may have one common motor.

In addition, the electrospinning apparatus of the present embodiment is not limited to the apparatus 10, but according to the apparatus 10, it is possible to provide a plurality of the vertical conveying paths 64 of the base material 40 on which the fiber is to be discharged, in a limited space of the apparatus, as described above. Further, it is possible to simultaneously form the fiber films respectively on the both surface of the base material 40, in the vertical conveying path 64. Accordingly, it is possible to miniaturize the apparatus 10, and also it is possible to improve a forming speed of the fiber film.

Next, a plurality of the heads 31 included in the head unit 30 will be described in detail, with reference to FIG. 3 to FIG. 6. In addition, since the respective heads 31 have the same structure, the one head 31 will be described in the following description.

As shown in FIG. 3, the head 31 has one or more nozzle units 311, and electric field control units 312.

The number of the nozzle units 311 can be changed arbitrarily in accordance with a width of the base material 40, and so on. The head 31 shown in FIG. 3 has the six nozzle units 311, for example. The nozzle units 311 are arranged in the width direction of the base material 40 within the range of the width of the base material 40. The width of the base material 40 is a width thereof in the Z direction in FIG. 1, for example.

Each of the nozzle units 311 has a nozzle 311*a*, a mounting body 311*b*, and a main body 311*c*.

To begin with, the nozzle 311*a* will be described below. The nozzle 311*a* is conductive and is resistant to the raw material liquid. The nozzle 311*a* has a needle-like shape extending in a direction facing the base material 40, for example. The nozzles 311*a* are arranged in parallel when seen from the Y direction, and in a line in the Z direction with a pitch p (refer to FIG. 3 and FIG. 4, for example). In addition, a plurality of the nozzles 311 are arranged not only in a line, but may be arranged in a plurality of lines.

The nozzle 311*a* has an opening for discharging the raw material liquid (fiber) toward the base material 40 at one end (hereinafter, sometimes called a tip) facing the base material 40. The nozzle 311*a* has a space that is a flow path of the raw material liquid not shown inside thereof. The nozzle 311*a* is mounted on the mounting body 311*b* at the other end. The nozzle 311*a* is connected to the power source 20 via the mounting body 311*b* and the main body 311*c*, and is applied with a voltage.

In addition, the shape of the nozzle 311*a* is not limited to a needle-like shape, but it is made to have a needle-like shape, and thereby electric field concentration becomes easy to occur at the tip of the nozzle 311*a*. When the electric field concentration occurs at the tip of the nozzle 311*a*, it is possible to enhance a strength of the electric field occurring between the nozzle 311*a* and the base material 40. Accordingly, it is possible to lower the voltage to be applied by the power source 20.

In addition, the tip of the nozzle 311*a* is sharpened, and thereby the electric field strength at the tip of the nozzle 311*a* can be concentrated, and accordingly, the nozzle 311*a* may have a cone shape with a sharp tip, for example.

The mounting body 311*b* will be described below. The mounting body 311*b* is detachably mounted on the main body 311*c* at a side opposite to a side on which the nozzle 311*a* is mounted, for example (refer to FIG. 3, for example).

Figure 4:
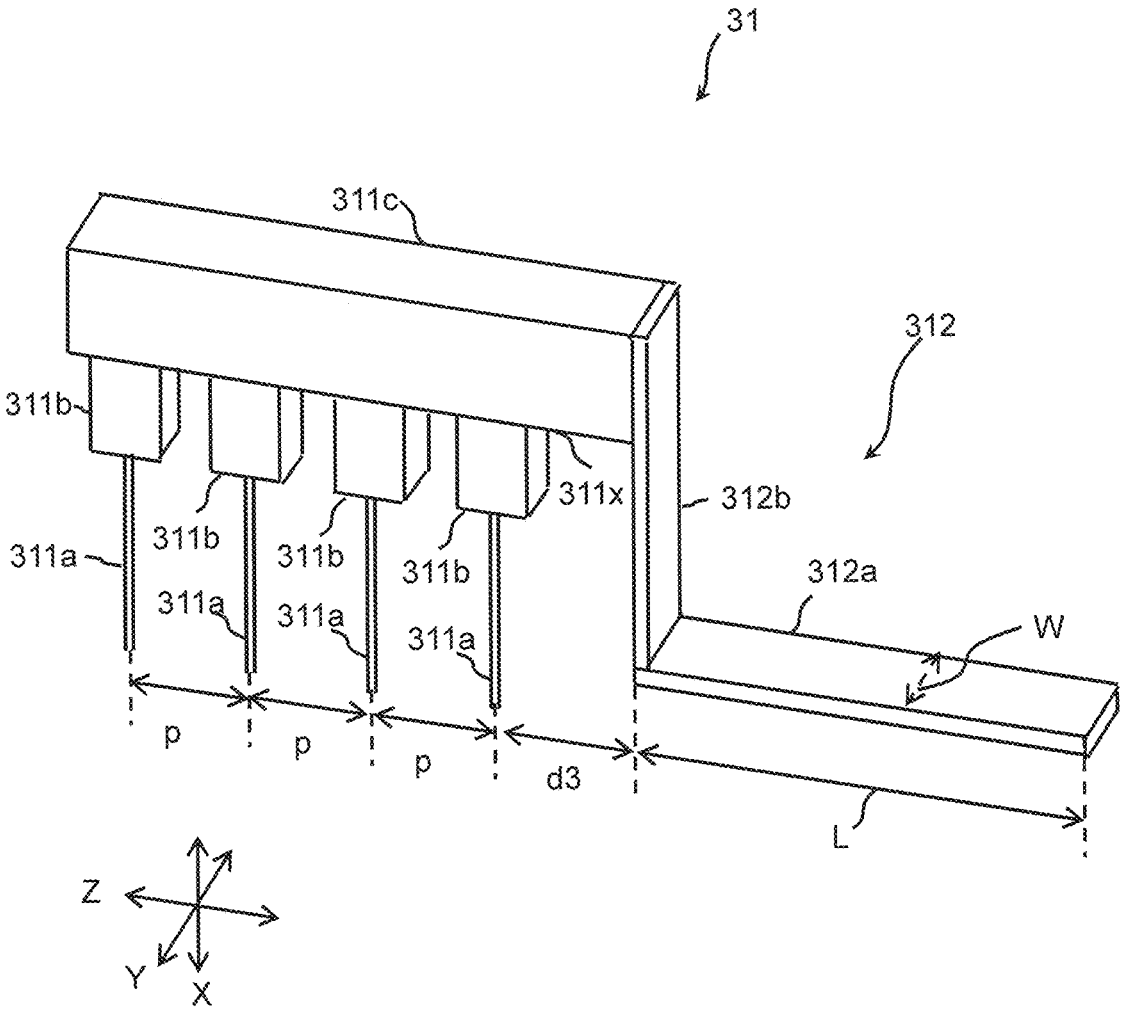
FIG. 4 is a perspective view showing the end portion of the head shown in FIG. 3.
Figure 5:
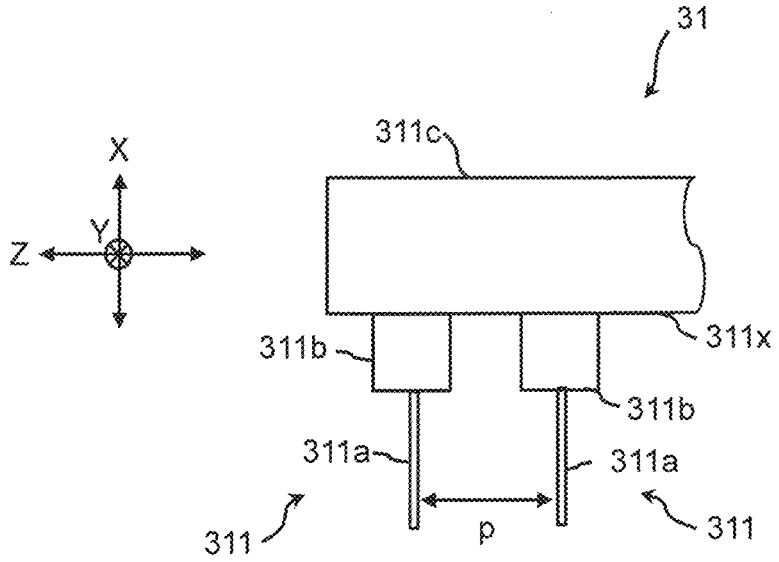
FIG. 5 is an enlarged side view showing the end portion of the head shown in FIG. 3.
Figure 6:
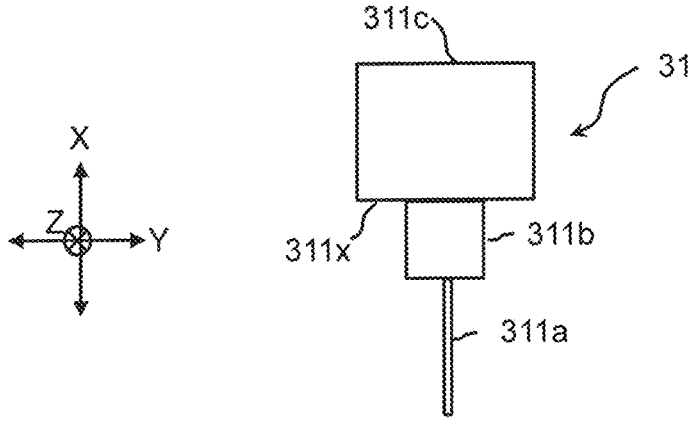
FIG. 6 is a side view of the head shown in FIG. 3 which is seen from the width direction of the base material.

The main body 311*c* will be described below. The main body 311*c* is conductive and is resistant to the raw material liquid. The main body 311*c* has four side surfaces extending in the Z direction (the width direction of the base material 40) as shown in FIG. 4 to FIG. 5, and is formed by a prism body having a quadrangular cross section shape (hereinafter simply called a quadrangular prism) as shown in FIG. 6.

The main body 311*c* is fixed to a mounting portion not shown so that one side surface 311*x* out of the four side surfaces faces the base material 40. The nozzle 311*a* is mounted on the side surface 311*x* via the mounting body 311*b*.

The main body 311*c* has a space that is a flow path of the raw material liquid not shown inside thereof. The flow path inside the main body 311*c* communicates with the flow path inside the mounting body 311*b*. In addition, the raw material liquid is fed to the flow path inside the main body 311*c* via the liquid feeding mechanism.

In addition, the main body 311*c* of the present embodiment is commonly used as the main bodies of a plurality of the nozzle units 311, but a plurality of the main bodies 311*c* may be provided respectively for a plurality of the nozzle units 311.

In addition, the side surface of the main body 311*c* on which a plurality of the nozzles 311*a* are arranged is not limited to one side surface thereof. For example, a plurality of the nozzles 311*a* may be arranged on each of the two different side surfaces of the main body 311*c*. In this case, the main body 311*c* is fixed to a mounting portion not shown so that the two side surfaces thereof face the base material 40 side.

In addition, the shape of the main body 311*c* may be a polygonal prism other than a quadrangular prism. Hereinafter, the head 31 in which the nozzles 311*a* are arranged on each of two side surfaces 311*y*, 311*z* of the main body 311*c* having a shape of a polygonal prism other than a quadrangular prism will be described, with reference to FIG. 7 to FIG. 9. In addition, the main body 311*c* has a plurality of portions 315 in each of which an apex portion is chamfered so that the electric field does not concentrate at a plurality of the apex portions between the different side surfaces. The side surfaces 311*y*, 311*z* are located while sandwiching the chamfered portion 315 therebetween.

The nozzles 311*a* are arranged in a line in the Z direction in each of the side surface 311*y*, 311*z* of the main body 311*c*. That is, the head 31 has a total of two nozzle lines.

Hereinafter, a plurality of the nozzles 311*a* to be arranged on the side surface 311*y* is sometimes called a first nozzle line 313. In addition, a plurality of the nozzles 311*a* to be arranged on the side surface 311*z* is sometimes called a second nozzle line 314. In addition, the nozzles 311*a* which belong to the first nozzle line 313 are sometimes called first nozzles 313*a*. Further, the nozzles 311*a* which belong to the second nozzle line 314 are sometimes called second nozzles 314*a*.

Figure 7:
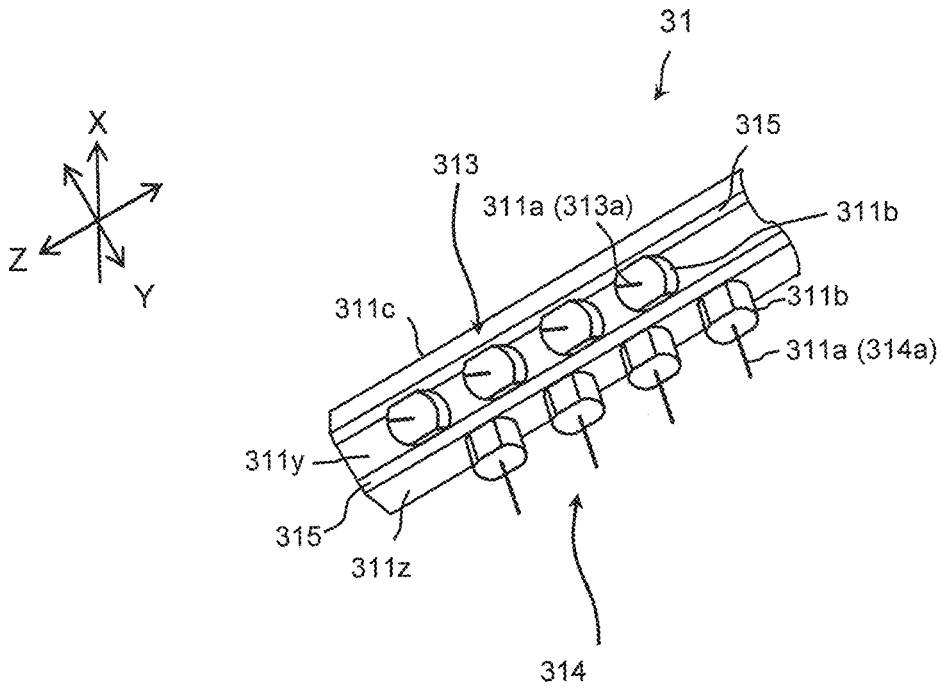
FIG. 7 is a perspective view showing another example of a head according to the embodiment.
Figure 8:
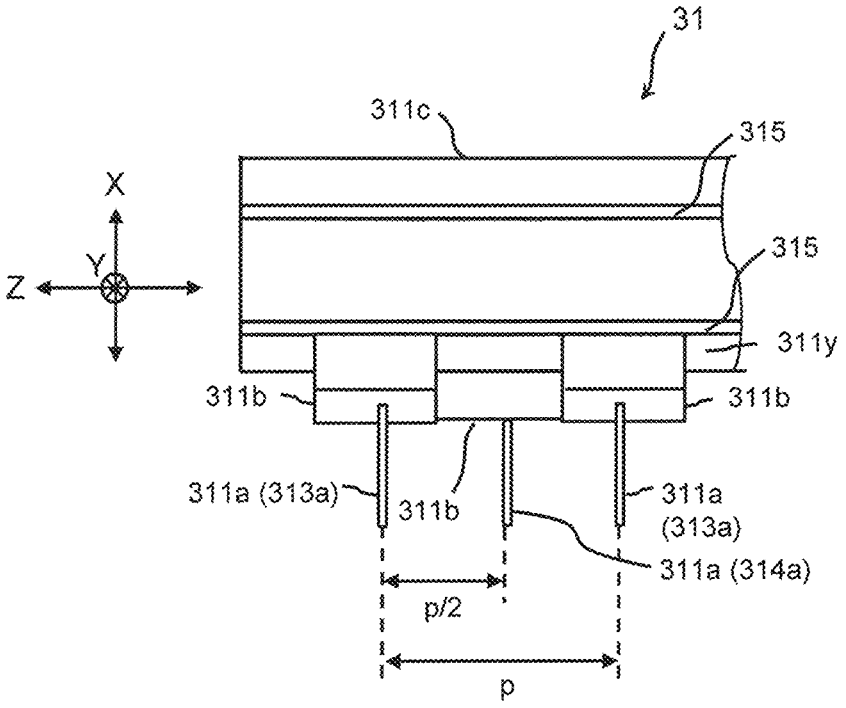
FIG. 8 is a side view showing the end portion of the head shown in FIG. 7 which is seen from the direction orthogonal to the width direction of the base material.

Positions of a plurality of the first nozzles 313*a* belonging to the first nozzle line 313 and positions of a plurality of the second nozzles 314*a* belonging to the second nozzle line 314 are respectively different in the Z direction as shown in FIG. 7 and FIG. 8.

For example, a plurality of the first nozzles 313*a* belonging to the first nozzle line 313 and a plurality of the second nozzles 314*a* belonging to the second nozzle line 314 can be arranged respectively at positions deviated from each other by ½ pitch (p/2) as shown in FIG. 8.

The positions of the first nozzles 313*a* and the second nozzles 314*a* are deviated in this manner, and thereby the fiber to be formed by the raw material liquid to be discharged from the second nozzle 314*a* belonging to the second nozzle line 314 can be deposited, between an area in the base material 40 on which the fiber is to be deposited by the raw material liquid to be discharged from the one first nozzle 313*a* belonging to the first nozzle line 313, and an area in the base material 40 on which the fiber is to be deposited by the raw material liquid to be discharged from the first nozzle 313*a* adjacent to the relevant one first nozzle 313*a*.

Accordingly, even when the pitch p of a plurality of the first nozzles 313*a* in the first nozzle line 313 and the pitch p of a plurality of the second nozzles 314*a* in the second nozzle line 314 are made longer, it is possible to suppress occurrence of unevenness in the fiber film to be formed on the base material 40. In addition, this means that an apparent pitch of a plurality of nozzles 311*a* in the Z direction is shortened. Accordingly, compared with a case in which the same number of nozzles 311*a* are arranged in a line, in this case, it is possible to make the length of the main body 311*c* shorter, and accordingly, it is possible to achieve miniaturization of the head 31.

Since the pitch p of a plurality of the first nozzles 313*a* in the first nozzle line 313 and the pitch p of a plurality of the second nozzles 314*a* in the second nozzle line 314 can be made longer, it is possible to suppress electric field interference between the tips of a plurality of the first nozzles 313*a* in the first nozzle line 313, and electric field interference between the tips of a plurality of the second nozzles 314*a* in the second nozzle line 314. Further, it is possible to suppress electric field interference between the tip of the first nozzle 313*a* belonging to the first nozzle line 313, and the tip of the second nozzle 314*a* belonging to the second nozzle line 314. As a result, it is possible to stabilize formation of the fiber film on the base material 40.

In addition, as shown in FIG. 8, the first nozzles 313*a* belonging to the first nozzle line 313 are arranged in parallel with each other when seen from the Y direction. The second nozzles 314*a* belonging to the second nozzle line 314 are arranged in parallel with each other when seen from the Y direction.

In addition, as shown in FIG. 8, the first nozzles 313*a* belonging to the first nozzle line 313 and the second nozzles 314*a* belonging to the second nozzle line 314 are arranged in parallel with each other when seen from the Y direction.

Figure 9:
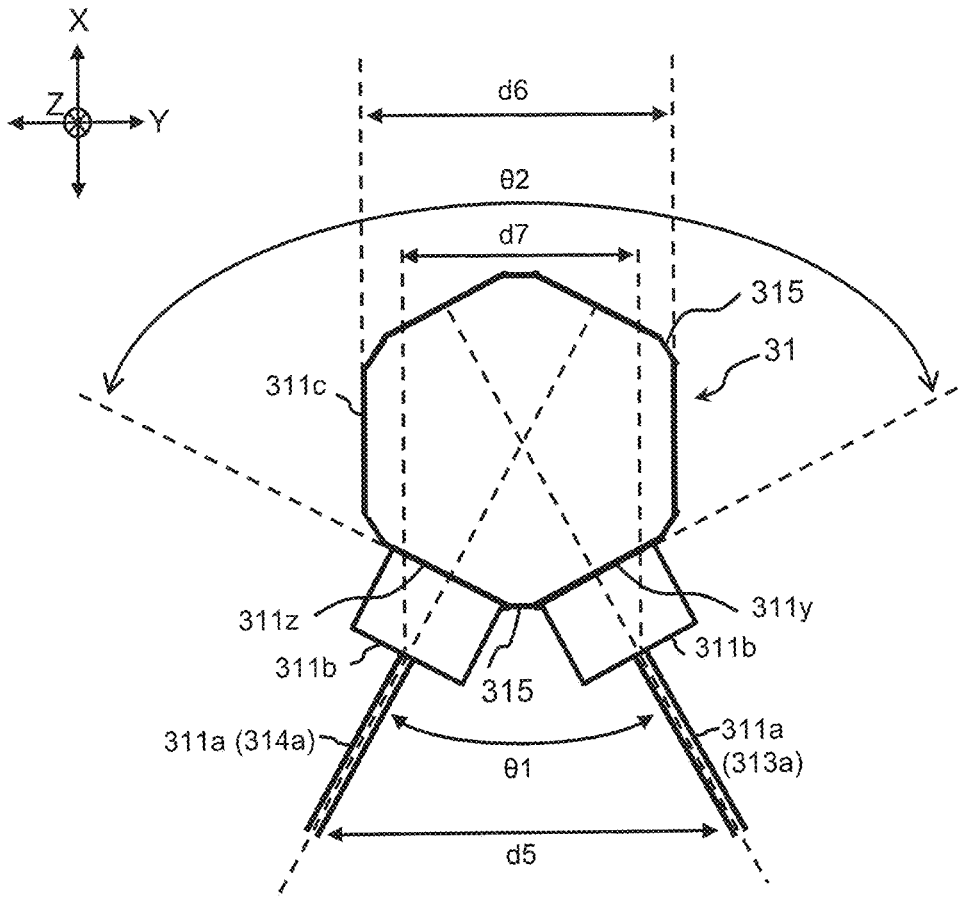
FIG. 9 is a side view of the head shown in FIG. 7 which is seen from the width direction of the base material.

However, as shown in FIG. 9, when seen from the Z direction, a direction in which a plurality of the second nozzles 314*a* belonging to the second nozzle line 314 extend intersects with a direction in which a plurality of the first nozzles 313*a* belonging to the first nozzle line 313 extend.

In addition, as shown in FIG. 9, when seen from the Z direction, a plurality of the second nozzles 314*a* belonging to the second nozzle line 314 extend to more separate from a plurality of the first nozzles 313*a* belonging to the first nozzle line 313, as approaching the tip sides, respectively.

In addition, as shown in FIG. 9, when seen from the Z direction, a distance d5 projected in the Z direction between the tips of a plurality of the first nozzles 313*a* belonging to the first nozzle line 313, and the tips of a plurality of the second nozzles 314*a* belonging to the second nozzle line 314 is longer than a cross sectional dimension d6 of the main body 311*c*.

The first nozzle line 313 and the second nozzle line 314 are configured as described above, and thereby the above-described distance d5 when seen from the Z direction can be made longer than a case in which a plurality of the first nozzle 313*a* belonging to the first nozzle line 313, and a plurality of the second nozzles 314*a* belonging to the second nozzle line 314 are arranged in parallel with each other.

Accordingly, it is possible to suppress occurrence of electric field interference between the tips of a plurality of the first nozzles 313*a* belonging to the first nozzle line 313, and the tips of a plurality of the second nozzles 314*a* belonging to the second nozzle line 314. As a result, it is possible to stabilize formation of the fiber film on the base material 40.

It is preferable that an angle θ1 (refer to FIG. 9) projected in the Z direction between a direction in which a plurality of the first nozzles 313*a* belonging to the first nozzle line 313 extend, and a direction in which a plurality of the second nozzle 314*a* belonging to the second nozzle line 314 extend is not less than 30° and not more than 150°. That is, that the angle θ1 is set to not less than 30° and not more than 150° is suitable for realizing miniaturization of the head 31, suppression of the electric field interference between the first nozzle line 313 and the second nozzle line 314, and stable formation of the fiber film on the base material 40. Further, in order to improve volatility of the raw material liquid, and in a case in which a plurality of heads 31 are arranged, it is more preferable that the angle θ1 is set to not less than 45° and not more than 75°.

In addition, a distance d7 (refer to FIG. 9) projected in the Z direction between the end portions at the mounting bodies 311*b* sides of a plurality of the first nozzles 313*a* belonging to the first nozzle line 313, and the end portions at the mounting bodies 311*b* sides of a plurality of the second nozzles 314*a* belonging to the second nozzle line 314 can be made shorter than the above-described distance d5 (refer to FIG. 9). Accordingly, it becomes easy to make the cross sectional dimension d6 of the main body 311*c* (refer to FIG. 9) shorter than the distance d5. If the cross sectional dimension d6 of the main body 311*c* can be made shorter than the distance d5, it is possible to achieve miniaturization of the head 31.

The main body 311*c* shown in FIG. 7 to FIG. 9 is a prism body having a cross section shape of a regular polygon. The cross section shape of the main body 311*c* is not limited, but since a regular polygon is line-symmetric, it is easy to arrange a plurality of nozzles 311*a* on each of a plurality of the side surfaces thereof.

The cross section shape of the main body 311*c* shown in FIG. 7 to FIG. 9 is a regular hexagon, for example. In this case, when the first nozzle line 313 is arranged on the side surface 311*y* of the main body 311*c*, and the second nozzle line 314 is arranged on the side surface 311*z* located while sandwiching the chamfered portion 315 therebetween, the above-described angle θ1 becomes 60°, and thereby the angle θ1 can be made within the above-described angle range of not less than 45° and not more than 75°. In addition, the cross section shape of the main body 311*c* may be made a circular shape, and a plane portion may be provided at a portion on which the nozzles 311*a* are to be arranged.

In addition, an angle formed by the side surface 311*y* and the side surface 311*z* is θ2, the above-described angle θ1 can be expressed by the following expression.

$$\theta 1 = 180° - \theta 2$$

In addition, the nozzle 311*a* shown in FIG. 7 to FIG. 9 can be mounted on the main body 311*c* via the mounting body 311*b*, in the same manner as the example shown in FIG. 3 to FIG. 5.

Next, the electric field control unit 312 will be described, with reference to FIG. 3 and FIG. 4. The electric field control unit 312 has the control body 312*a* and a connecting body 312*b*.

To begin with, the control body 312*a* will be described below. The control body 312*a* is conductive and is resistant to the raw material liquid. The control body 312*a* is mounted on one end of the connecting body 312*b*. In addition, the connecting body 312*b* is mounted on the main body 311*c* of the nozzle unit 311, as described later. In addition, the main body 311*c* is connected to the power source 20 as described above.

Accordingly, the control body 312*a* is applied with the voltage having the same polarity and the same value as those of the voltage to be applied to nozzle 311*a* by the power source 20, via the main body 311*c* and the connecting body 312*b*.

In addition, the control bodies 312*a* are mounted on the connecting bodies 312*b*, and thereby the control bodies 312*a* are arranged at the both ends in the Z direction of the head 31 (refer to FIG. 3, for example).

That is, the control body 312*a* is arranged in the vicinity of the outermost nozzle unit 311 out of a plurality of the nozzle units 311 arranged in the Z direction. Specifically, the control body 312*a* is arranged adjacent to the nozzle 311*a* included in the outermost nozzle unit 311 with an interval d3 (refer to FIG. 4).

It is preferable that the interval d3 is not less than the pitch p of the respective nozzles 311*a*. When the interval d3 becomes narrower than the pitch p, electric field interference occurs between the control body 312*a* and the nozzle 311*a*.

Further, the control body 312*a* is arranged so as to extend in the outside direction of the spinning space S (refer to FIG. 3) in which the tips of the nozzles 311*a* are opposite to the base material 40, and in the width direction (the Z direction) of the base material 40.

The direction in which the control body 312*a* extends toward the outside of the spinning space S is substantially orthogonal to the direction (refer to the X direction in FIG. 3, for example) in which the nozzle 311*a* extends toward the base material 40, for example. To be substantially orthogonal includes a range of ±5° with respect to a direction orthogonal to the direction in which the nozzles 311*a* extends toward the base material 40.

In addition, when the control body 312 is nearer to the base material 40 than the tip of the nozzle 311*a*, a possibility of breakdown occurs. Accordingly, the control body 312*a* is mounted on the connecting body 312*b*, and thereby the control body 312*a* is arranged to have a height h (≥0) from the tip of the nozzle 311*a* (refer to FIG. 3).

The control body 312*a* has a length L (for example, refer to FIG. 3) in the direction in which the control body 312*a* extends toward the outside of the spinning space S. The length L is preferably not less than 3/20 of a distance d2 between the tip of the nozzle 311*a* and the base material 40, and is more preferably not less than 3/10 of the distance d2.

The control body 312*a* has a width W in the direction orthogonal to the direction of the length L (refer to FIG. 4). The width W is not particularly limited. Accordingly, the control body 312*a* may be a plate-like member as shown in FIG. 4, or may be a rod-like member, for example. However, in the case of the head 31 shown in FIG. 7 to FIG. 9, the control body 312*a* has a width not less than the above-described distance d5 (refer to FIG. 9) so as to obtain a suitable effect of flight control of the fiber.

Hereinafter, the connecting body 312*b* will be described. The connecting body 312*b* is a plate-like member, for example, and is conductive and is resistant to the raw material liquid. The connecting bodies 312*b* are mounted on the both ends of the main body 311*c* of the nozzle unit 311, at the other end sides opposite to one ends on which the control bodies 312*a* are mounted. The connecting bodies 312*b* are mounted on the main body 311*c*, and thereby the control bodies 312*a* are arranged at the above-described positions and in the above-described directions.

In addition, the connecting body 312*b* electrically connects the main body 311*c* of the nozzle unit 311 and the control body 312*a*. Accordingly, the power source 20 to apply the voltage to the nozzle unit 311 can be commonly used as a power source to apply the voltage to the control body 312*a*.

In addition, a support for arranging the control body 312*a* as described above may be provided, in place of the control body 312*b*. In addition, a terminal for applying the voltage to the control body 312*a* may be provided, in place of the connecting body 312*b*.

In addition, it is not necessary that the control body 312*a* and the connecting body 312*b* are separate members. For example, the control body 312*a* and the connecting body 312*b* may be formed by binding an identical member.

Hereinafter, flight control of the fiber by the control body 312*a* of the control unit 312 will be described.

With the above-described configuration, the control body 312*a* of the control unit 312 is applied with the voltage by the power source 20, and thereby the control body 312*a* makes an electric field to be generated at the periphery of each of the both end portions of the head 31 (at the peripheries of the outermost nozzle units 311).

As described above, the fiber to be discharged from the head 31 flies in the direction of the base material 40 to be conveyed in the vertical conveying path 64, and also tries to fly in the width direction (refer to the Z direction of FIG. 3) of the base material 40 other than the direction of the base material 40 to be conveyed in the vertical conveying path 64.

In contrast, the control body 312*a* makes the electric field to be generated at the periphery of each of the both end portions of the head 31, and thereby the control body 312*a* suppresses spread of flight of the fiber to be discharged from the head 31 (the nozzle 311*a*) in the width direction of the base material 40, and controls the fiber so as to be induced to the base material 40.

Specifically, the control body 312*a* suppresses flight of the fiber to the outside (the Z direction side) from the spinning space S between the head 31 and the base material 40 in FIG. 3.

Figure 11:
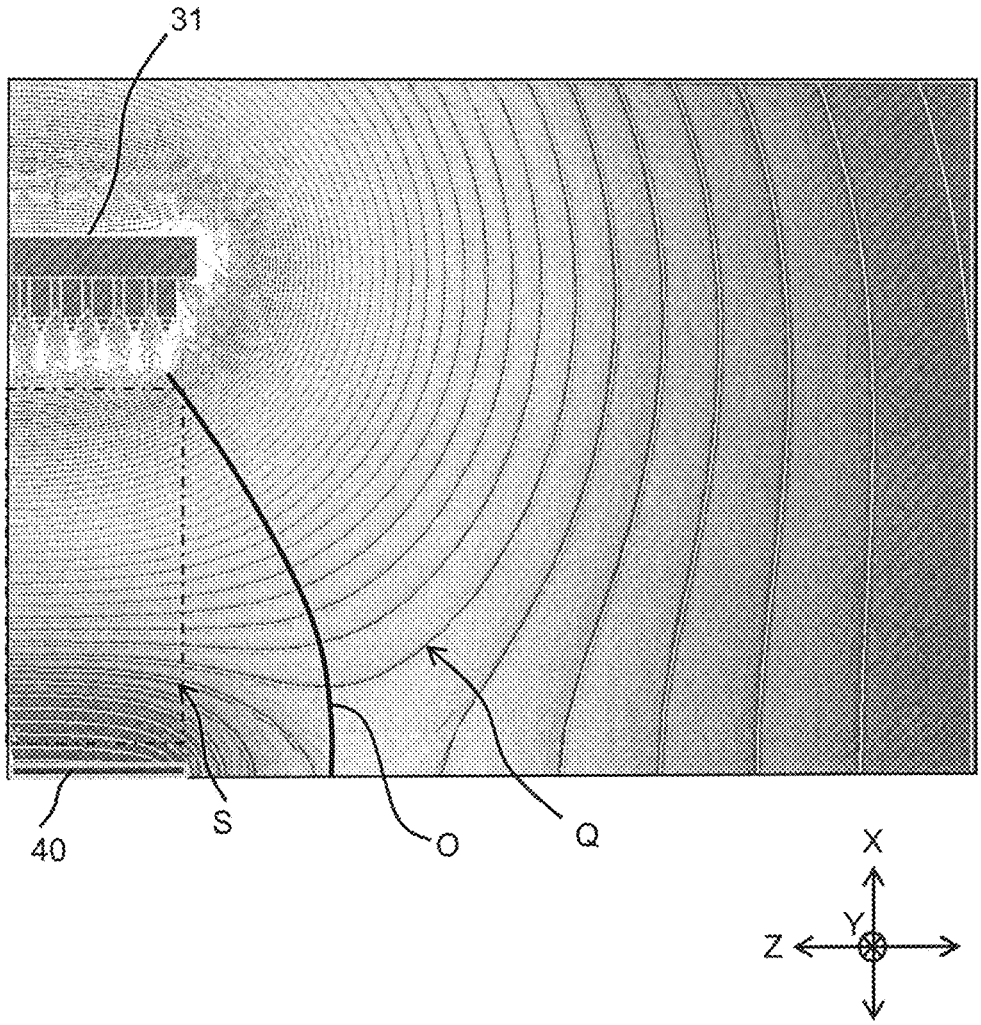
FIG. 11 is a simulation diagram showing equipotential lines at an end portion of a head according to a comparative example of the embodiment.
Figure 12:
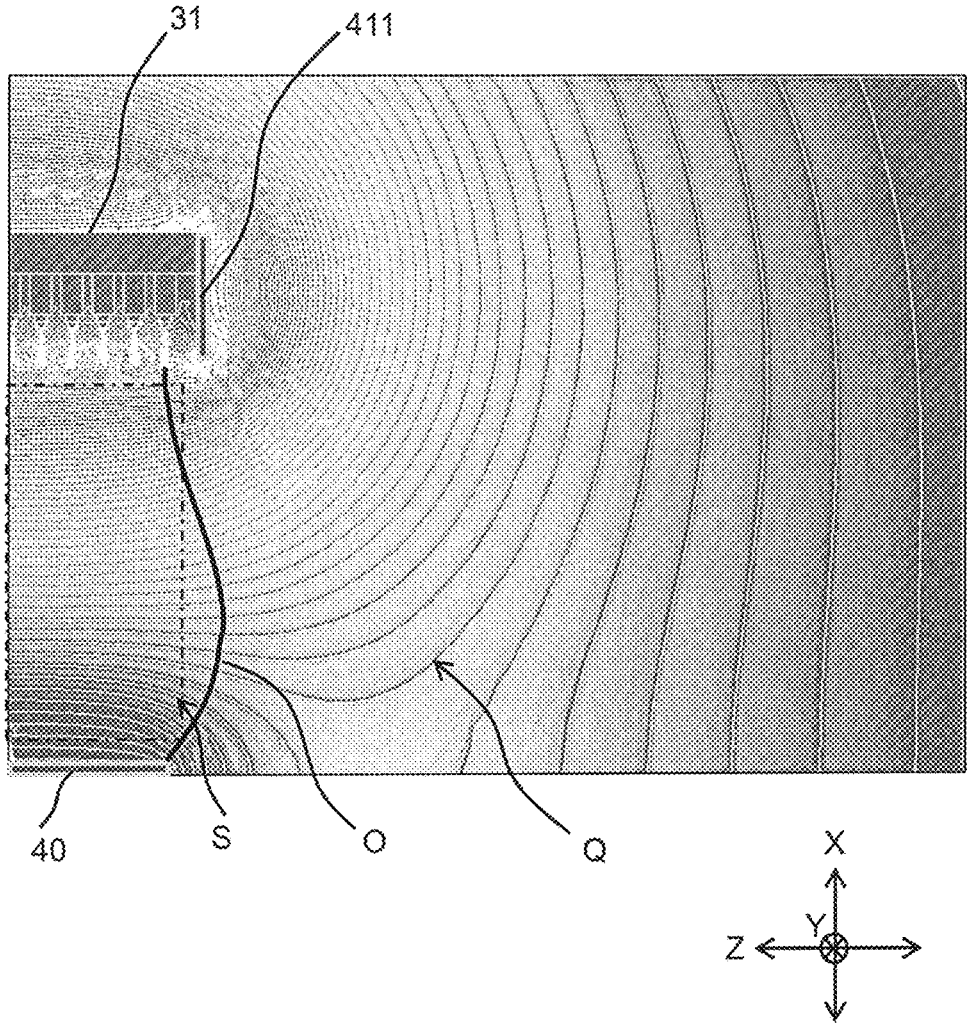
FIG. 12 is a simulation diagram showing equipotential lines at an end portion of a head according to a comparative example of the embodiment.
Figure 13:
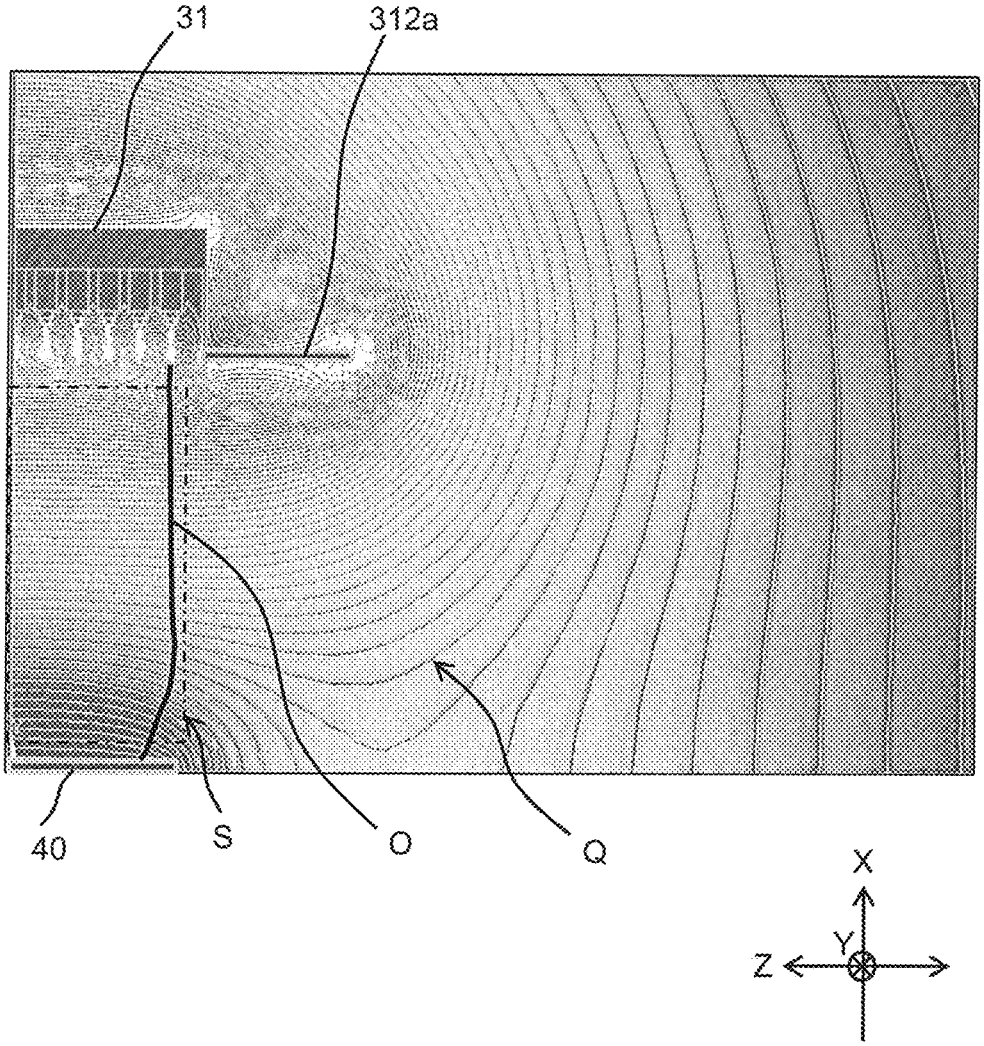
FIG. 13 is a simulation diagram showing equipotential lines at the end portion of the head according to the embodiment.

The flight control of the fiber by the control body 312*a* will be specifically described, with reference to FIG. 11 to FIG. 13.

FIG. 11 is a simulation diagram showing a distribution of equipotential lines Q in the spinning space S in the case in which the control body 312*a* is not arranged, and at the periphery of the outside thereof.

FIG. 12 is a simulation diagram showing a distribution of equipotential lines Q in the spinning space S in the case in which a conventional electric field control unit 411 is arranged in place of the control body 312*a*, and at the periphery of the outside thereof. The conventional electric field control unit 411 is a plate-like member extending in the same direction as the direction (the X direction) in which the nozzle 311*a* extends.

FIG. 13 is a simulation diagram showing a distribution of equipotential lines Q in the spinning space S in the case in which the control body 312*a* according to the present embodiment is arranged, and at the periphery of the outside thereof.

It can be confirmed that compared with the distributions of the equipotential lines Q in the spinning space S in FIG. 11 and FIG. 12, the distribution of the equipotential lines Q in the spinning space S in FIG. 13 is flatter (parallel along the Z direction).

In addition, it can be confirmed, from central orbits O of the flying fibers estimated from the equipotential lines Q, that compared with the cases of FIG. 11 and FIG. 12, in the case of FIG. 13, spread of the flying fiber in the Z direction is suppressed, and the flying fiber is induced to the base material 40.

Next, a control configuration of the apparatus 10 will be described, with reference to FIG. 10. FIG. 10 is a block diagram showing an example of a control configuration of the apparatus 10.

Figure 10:
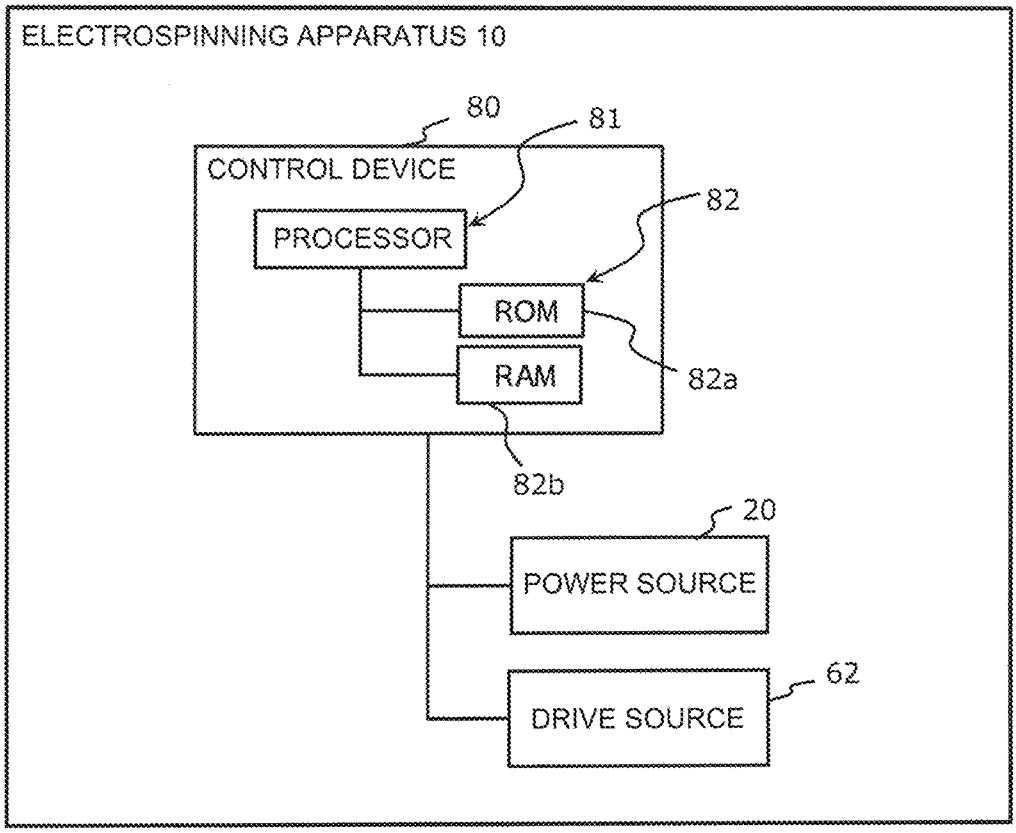
FIG. 10 is a block diagram showing an example of a control configuration of the apparatus according to the embodiment.

As shown in FIG. 10, the apparatus 10 has a control device 80. The power source 20 and the drive source 62 which have been described above, for example, and a liquid feeding mechanism not shown, and so on are connected to the control device 80.

The control device 80 includes a processor 81 and a memory 82. The processor 81 includes a CPU, or an MPU, for example. The memory 82 includes a ROM 82*a* and a RAM 82*b*, for example.

The processor 81 controls the whole operation of the apparatus 10. The ROM 82*a* stores a control program and so on for a control operation by the processor 81, for example. The RAM 82*b* provides a work area for developing the control program and so on read from the ROM 82*a*, for example.

For example, the processor 81 reads the control program stored in the ROM 82*a*, and develops the control program in the RAM 82*b*. The processor 81 controls the power source 20 and the liquid feeding mechanism not shown, and so on, in accordance with the control program, in order to make the raw material liquid to be discharged from the head unit 30.

In addition, the processor 81 controls the drive source 62, in accordance with the control program, in order to convey the base material 40. Further, the processor 81 controls the power source 20, in accordance with the control program, in order to apply the voltage to the control body 312*a*.

As described above, the head 31 according to the embodiment has the control body 312*a* which is arranged in the vicinity of the outermost nozzle unit 311 in the width direction of the base material 40, and extends toward the outside of the spinning space S between the nozzle unit 311 and the base material 40. The control body 312*a* is applied with the voltage of the same polarity as the voltage to be applied to the nozzle unit 311, and thereby makes the electric field to be generated at the periphery of the end portion of the head 31 (at the periphery of the outermost nozzle unit 311). According to the head 31 according to the embodiment, spread of flight of the fiber to be discharged from the nozzle unit 311 can be suppressed, and the induction of the fiber to the base material 40 can be controlled, by the control body 312*a*.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electrospinning head, comprising:

a nozzle unit configured to be arranged opposite to a base material and discharge a raw material liquid of fiber by being applied with a voltage; and a control body configured to be arranged in the vicinity of the nozzle unit so as to extend in an outside direction of a spinning space between the base material and the nozzle unit and make an electric field to be generated at the periphery of the nozzle unit by being applied with a voltage of the same polarity as the voltage to be applied to the nozzle unit, wherein the nozzle unit has a main body of a polygonal prism, and nozzles which are arranged on two different side surfaces of the main body and are capable of discharging the raw material liquid toward the base material;

the control body has a prescribed width in a direction orthogonal to the direction in which the control body extends to the outside of the spinning space; and the prescribed width is larger than an interval, projected in the width direction of the base material, between tips of the nozzles to be arranged on the respective different side surfaces out of the two different side surfaces.

2. The electrospinning head according to claim 1, wherein:

the direction in which the control body extends to the outside of the spinning space is a direction substantially orthogonal to a direction in which the nozzle unit extends in a direction of the base material.

3. The electrospinning head according to claim 2, wherein:

a length of the control body in the direction in which the control body extends to the outside of the spinning space is not less than 3/20 of a distance between a tip of the nozzle unit capable of discharging the raw material liquid and the base material.

4. The electrospinning head according to claim 1, wherein:

in the nozzle unit one of the nozzles is arranged on at least one side surface of the main body and is capable of discharging the raw material liquid toward the base material.

5. An electrospinning apparatus, comprising:

a conveying device configured to convey a base material; and an electrospinning head configured to discharge a raw material liquid of fiber toward the base material to be conveyed by the conveying device;

the electrospinning head including a nozzle unit configured to be arranged opposite to the base material and discharge the raw material liquid of fiber by being applied with a voltage, and a control body configured to be arranged in the vicinity of the nozzle unit so as to extend in an outside direction of a spinning space between the base material and the nozzle unit and make an electric field to be generated at the periphery of an end portion of the nozzle unit by being applied with a voltage of the same polarity as the voltage to be applied to the nozzle unit, wherein the nozzle unit has a main body of a polygonal prism, and nozzles which are arranged on two different side surfaces of the main body and are capable of discharging the raw material liquid toward the base material;

the control body has a prescribed width in a direction orthogonal to the direction in which the control body extends to the outside of the spinning space; and the prescribed width is larger than an interval, projected in the width direction of the base material, between tips of the nozzles to be arranged on the respective different side surfaces out of the two different side surfaces.

6. The electrospinning apparatus according to claim 5, wherein:

the direction in which the control body extends to the outside of the spinning space is a direction substantially orthogonal to a direction in which the nozzle unit extends in a direction of the base material.

7. The electrospinning apparatus according to claim 6, wherein:

a length of the control body in the direction in which the control body extends to the outside of the spinning space is not less than 3/20 of a distance between a tip of the nozzle unit capable of discharging the raw material liquid and the base material.

8. The electrospinning apparatus according to claim 5, wherein:

in the nozzle unit one of the nozzles is arranged on at least one side surface of the main body and is capable of discharging the raw material liquid toward the base material.

* * * * *